US005415987A

United States Patent [19]

Tsukada

[11] Patent Number: 5,415,987

[45] Date of Patent: May 16, 1995

[54] SILVER HALIDE PHOTOGRAPHIC LIGHT-SENSITIVE MATERIAL

[75] Inventor: Kazuya Tsukada, Hino, Japan

[73] Assignee: Konica Corporation, Japan

[21] Appl. No.: 225,231

[22] Filed: Apr. 8, 1994

[30] Foreign Application Priority Data

Apr. 16, 1993 [JP] Japan ..... 5-090077

[51] Int. Cl.[6] ..... G03C 1/76

[52] U.S. Cl. ..... 430/535; 430/536; 430/523; 430/567; 430/961; 430/496

[58] Field of Search ..... 430/536, 535, 523, 567, 430/961, 496

[56] References Cited

U.S. PATENT DOCUMENTS

| | | | |
|---|---|---|---|
| 4,439,520 | 3/1984 | Kofron et al. | 430/567 |
| 4,507,385 | 3/1985 | Steklenski et al. | 430/523 |
| 4,612,279 | 9/1986 | Steklenski et al. | 430/523 |
| 4,822,727 | 4/1989 | Ishigaki et al. | 430/536 |
| 5,173,396 | 12/1992 | Nagasaki et al. | 430/536 |
| 5,179,147 | 1/1993 | Jones | 430/536 |
| 5,298,376 | 3/1994 | Szajewski et al. | 430/536 |

FOREIGN PATENT DOCUMENTS

| | | |
|---|---|---|
| 535535 | 4/1993 | European Pat. Off. . |
| 198047 | 8/1988 | Japan . |

*Primary Examiner*—Thomas R. Neville

*Attorney, Agent, or Firm*—Jordan B. Bierman; Bierman and Muserlian

[57] ABSTRACT

A silver halide photographic light-sensitive material is disclosed. The light-sensitive material comprises a support having thereon a silver halide emulsion layer and a hydrophilic colloid layer provided at the farthest position from the surface of the support on which the emulsion layer is provided. In the light-sensitive material, the silver halide emulsion layer contains tabular silver halide grains each having an aspect ratio of not less than 3; and the hydrophilic colloid layer contains a polymer latex comprising a polymer which comprises a repeating unit derived from a monomer having a solubility in water of not higher than 0.025 % in weight at 25° C.

12 Claims, No Drawings

SILVER HALIDE PHOTOGRAPHIC LIGHT-SENSITIVE MATERIAL

FIELD OF THE INVENTION

This invention relates to a silver halide photographic light-sensitive material and, particularly, to a silver halide photographic light-sensitive material capable excellently displaying a scratch resistance and a drying property when rapidly processing it through an automatic processor.

BACKGROUND OF THE INVENTION

In recent years, a silver halide photographic light-sensitive material has been required to display a rapid processability and, particularly, to display such a rapid processing function as a super-rapid processing function performable within 45 seconds from Dry to Dry, in addition to a high sensitive speed, a high contrast, an excellent graininess, an image sharpness and so forth. Particularly, an X-ray photographic light-sensitive material for medical diagnostic use has been required to process it rapidly so that a decisive diagnosis can be made earlier. For example, a rapid processing has been inevitable for an angiography for which a catheter is inserted in a blood vessel and a contrast medium is injected at a high pressure therein, or for a under-operation photography in which an X-ray photograph is taken under operation.

As for a means for satisfying the above-mentioned requirements, a photographing, transporting, processing and so forth have been automated and, at the same time, a rapid processability has been tried to provide to a silver halide photographic light-sensitive material. However, a rapid process has had such a problem that an image quality is deteriorated by a high temperature (at 30° to 40° C.) and a high pH, a dryness has not been maintained by a high-speed transportation and a carry-over increase caused by a processing chemical.

For satisfying the above-mentioned requirements for a high image quality, tabular-shaped silver halide grains have recently been used. Tabular-shaped silver halide grains have a large specific surface area. It has, therefore, been observed that a color sensitization efficiency has been improved by a sensitizing dye, that is, the so-called covering power has been improved. Also, in a silver halide photographic light-sensitive material for X-ray photographic use, a cross-over light has remarkably been reduced and, at the same time, an image having a few light scattering and a high resolving power has also been obtained.

However, the above-mentioned tabular-shaped grains have had such a defective that a pressure fog has been produced, such as a blacked trouble produced by an external force such as a bent of an unexposed light-sensitive material in handling or a streaky fog produced by a member coming into contact with the grains in transportation through an automatic processor and so forth.

Therefore, the attempts have been studied so far to improve a pressure resistance by making use of various means. For example, some improvements thereof have been achieved by making use of an emulsion comprising a core/shell type silver halide having a highly silver iodide containing silver iodobromide phase inside the crystals of the grains. However, in the above-mentioned improvements, there has been such a defect that a trouble of clearing an image into white is produced, that is not be satisfiable.

When making use of a binder component in an amount necessary for improving a scratch resistance, a processabilities including, particularly, a dryness and carry-over are seriously deteriorated.

As for a means for improving a blackening trouble, U.S. Pat. No. 3,632,342 discloses a means of adding a latex with the purpose of moderating an external pressure. When a latex is added to a silver halide emulsion layer in the above-mentioned means, sensitometric characteristics such as a sensitive speed, a gamma, the maximum density and fogginess are seriously deteriorated in preservation.

When adding it to a protective layer, an antistaticity is seriously deteriorated so as to produce a static mark, or to cause a transportation failure due to the stickiness of a film to another film.

After making various studies on the invention, it was discovered not only that an antistaticity and a stickiness prevention can be improved together with improving a scratch resistance, but also that any sensitometric characteristics cannot be deteriorated, when a polymer latex of the invention is added to a protective layer.

It was amazed to find out that, as a film surface is modified by applying a latex of the invention to a protective layer, an adhering amount of water drops can be reduced after completing a washing step and, resultingly, a dryness can be remarkably improved.

SUMMARY OF THE INVENTION

To such a problem as described above, an object of the invention is to provide a silver halide photographic light-sensitive material having a high sensitive speed, an excellent dryness and a scratch resistance, without spoiling any photographic characteristics even in a super-rapid process.

The above object of the invention can be achieved with a silver halide photographic light-sensitive material comprising a support having thereon a silver halide emulsion layer and a hydrophilic colloid layer provided at the farthest position from the emulsion coated side of the support, in which the silver halide emulsion layer contains tabular silver halide grains each having an aspect ratio of not less than 3; and the hydrophilic colloid layer contains a polymer latex comprising a polymer which comprises a repeating unit derived from a monomer having a solubility in water of not higher than 0.025% in weight at 25° C.

DETAILED DESCRIPTION OF THE INVENTION

An emulsion applicable to a photographic light-sensitive material of the invention can be prepared in any known process. For example, the emulsions applicable thereto can be prepared in the process described in Research Disclosure (RD) No. 17643 (Dec., 1978), pp. 22–23, Chap. 1, (Emulsion Preparation and Types) and, ibid., (RD) No. 18716, (Nov., a979 ), p. 648.

The emulsions applicable thereto can also be prepared in the processes such as those described in T. H. James, "The theory of the photographic process", the 4th Ed., MacMillan Publishing Co. , (1977 ) , pp. 38–104; G. F. Dauffin, "Photographic Emulsion Chemistry", Focal Press, Inc., (1966); P. Glafkides, "Chimie et physique photographique", Paul Montel Co., (1967); and V. L. Zelikman et al, "Making and Coating Photographic Emulsion", Focal Press, Inc., (1964).

To be more concrete, the emulsions can be prepared under the conditions of a solution used in a neutral process, an acidic process or an ammoniacal process, the mixing conditions used in a normal precipitation process, a reverse precipitaton process, a double-jet precipitation process or a controlled double-jet precipitation process, the conditions for preparing grains used in a conversion process or a core/shell process, or the combination of the above-mentioned processes. One of the embodiments of the invention include, for example, a monodisperse type emulsion localizing silver iodide in the molecules thereof.

In the present invention, tabular grains are preferably used. The average grain size of the tabular silver halide grains relating to the present invention is preferably 0.2 to 2.5 μm, more preferably, 0.5 to 2.0 μm.

In the present invention, the tabular grain is that having an of grain aspect ratio, diameter/thickness, of not less than 3. A tabular grain having a aspect ratio of 6 to 60 is preferably, more preferably 7 to 50, further preferably 8 to 20 use in the emulsion layer in the invention.

The thickness of tabular grain is preferably not more than 0.4 μm, more preferably not more than 0.3 μm, further preferably 0.05 to 0.25 μm.

In the present invention, the diameter of a silver halide grain is defined as the diameter of a circle having the same area as the projected area of the grain as observed on an electron micrograph of the grain. The thickness of a silver halide grain is defined as the least distance between two parallel principal planes constituting the tabular silver halide grain.

The thickness of a tabular silver halide grain can be obtained from an electron micrograph shadowed with the silver halide grain or an electron micrograph of a sampled cross-section of the silver halide grain in an emulsion coated and dried on the support.

In the silver halide emulsion of the present invention, the total projection area of the tabular grains having an aspect ratio of not less than 3 account for not less than 50%, preferably not less than 60%, most preferably not less than 70% of the total projection area of the whole silver halide grains contained in the emulsion.

The tabular silver halide emulsion is preferably a monodisperse emulsion, with greater preference given to a tabular silver halide emulsion wherein silver halide grains whose diameter falls within the range of ±20% of the average grain size account for not less than 50% by weight of all grains.

The tabular silver halide emulsion may have any halogen composition such as silver chloride, silver bromide, silver chlorobromide, silver iodobromide and silver chloroiodobromide. From the viewpoint of high sensitivity, silver bromide or silver iodobromide is preferred, the average silver iodide content being 0 to 4.0 mol %, preferably 0.2 to 3.0 mol %, and average silver chloride content is 0 to 5 mol %.

A tabular silver halide emulsion can be produced in accordance with Japanese Patent O.P.I. Publication Nos. 113926/1983, 113927/1983, 113934/1983 and 1855/1987 and European Patent Nos. 219,849 and 219,850. A monodisperse silver halide emulsion can be produced in accordance with Japanese Patent O. P. I. Publication No. 6643/1986.

A tabular silver iodobromide emulsion having a high aspect ratio can be produced by simultaneously adding an aqueous solution of silver nitrate or both an aqueous solution of silver nitrate and an aqueous solution of a halide to an aqueous solution of gelatin being kept at a pBr of not more than 2, to form a seed crystal, and growing the seed crystal by the double jet method.

The size of tabular silver halide grains can be controlled by temperature and rates of addition of the aqueous solutions of silver salt and halide during grain formation.

The average silver iodide content of the tabular silver halide emulsion can be controlled by changing the composition of the aqueous halide solution added, i.e., the ratio of the bromide and iodide.

To remove soluble salts, the emulsion may be washed by noodle washing, flocculation precipitation or the like. Preferred washing methods for desalinization include the method described in Japanese Patent Examined Publication No. 16086/1960, which uses an aromatic hydrocarbon series aldehyde resin containing the sulfo group, and the method described in Japanese Patent O. P. I. Publication No. 158644/1988, which uses example polymeric flocculants G3 and G8.

The silver halide emulsion relating to the present invention may incorporate various photographic additives added before or after physical ripening or chemical ripening. Such additives include those described in Research Disclosure Nos. 17643 (December 1978), 18716 (November 1979) and 308119 (December 1989) (hereinafter referred to as RD17643, RD18716 and RD308119, respectively). The following table shows where the additives are described.

| | RD17643 | | RD18716 | RD308119 | |
|---|---|---|---|---|---|
| Additive | Page | Cate. | Page | Page | Cate. |
| Chemical sensitizer | 23 | III | 648 upper right | 996 | III |
| Sensitizing dye | 23 | IV | 648–649 | 996–998 | IV |
| Desensitizing dye | 23 | IV | | 998 | B |
| Dye | 25–26 | VIII | 649–650 | 1003 | VIII |
| Developing accelerator | 29 | XXI | 648 upper right | | |
| Antifogging agent/ stabilizer | 24 | IV | 649 upper right | 1006–1007 | VI |
| Brightening agent | 24 | V | | 998 | V |
| Hardener | 26 | X | 651 left | 1004–1005 | X |
| Surfactant | 26–27 | XI | 650 right | 1005–1006 | XI |
| Antistatic agent | 27 | XII | 650 right | 1006–1007 | XIII |
| Plasticizer | 27 | XII | 650 right | 1006 | XII |
| Lubricant | 27 | XII | | | |
| Matting agent | 28 | XVI | 650 right | 1008–1009 | XVI |
| Binder | 26 | XXII | | 1003–1004 | IX |
| Support | 28 | XVII | | 1009 | XVII |

As the support used in a light-sensitive material re;-relating to the invention, for example, ones described on page 28 of RD-17643 and page 1009 of RD-308119 may be used. Preferable support is a plastic film, to the surface of which a subbing layer coating, corona discharge treatment or ultraviolet irradiation may be applied to enhance the adhesivness of the surface to a coating layer provided on the surface.

In the silver halide photographic light-sensitive material of the invention, a hydrophilic colloid layer is provided at the farthest position from the support as a protective layer for silver halide light-sensitive emulsion layer. As colloids which can be used for such purpose, hydrophilic colloids commonly used in the field of photography such as gelatin, colloidal albumin, polysaccharides, cellulose derivatives, synthetic resins, polyvinyl compounds including polyvinyl alcohol derivatives, polyacrylamide can be exemplified.

At least one of the monomers for use in forming the polymer latex of the invention has a solubility in water at 25° C. of preferably not more than 0.025% by weight, and more preferably not more than 0.015% by weight. Examples of such the ethylenic monomer include acrylates such as hexyl acrylate, 2-ethyl-hexyl acrylate, octyl acrylate, tert-octyl acrylate, nonyl acrytate, iso-nonyl acrylate, cyclohexyl acrylate, n-stearyl acrylate, lauryl acrylate and tridecyl acrylate; methacrylates such as hexyl methacrylate, 2-ethyl-hexyl methacrylate, octyl methacrylate, iso-octyl methacrylate, tertoctyl methacrylate, nonyl methacrylate, iso-nonyl methacrylate, cyclohexyl methacrylate, n-stearyl methacrylate, lauryl methacrylate and tridecyl methacrylate; and divinyl benzene.

The solubility in water at 25° C. of the monomer for use in forming the latex of the invention can be measured according to the method described in the Shin Jikken Kagaku Koza, Kihon Sosa 1, P. P. 223–250', ('New Experimental Chemistry Course: Basic Operations 1') (Maruzene Kagaku, 1975). When measured according to this method, the solubility in water at 25° C. of, e.g., 2-ethyl-hexyl acrylate is 0.01% by weight, 2-ethyl-hexyl methacrylate 0.005 by weight, cyclohexyl methacrylate 0.00% by weight, whereas in the case of commonly used monomers, styrene 0.03% by weight, butyl acrylate 0.32% by weight and butyl methacrylate 0.03% by weight.

For the polymer latex used in the invention, copolymerization of the above monomer compound with different other monomer compounds may be carried out. Examples of copolymerizable ethylenic monomer compounds include acrylates, methacrylates, vinyl esters, olefins, styrenes, crotonic acid esters, iraconic acid diesters, maleic acid diesters, fumaric acid diesters, acrylamides, acryl compounds, vinyl ethers, vinyl ketones, vinyl heterocyclic compounds, glycidyl esters, unsaturated nitriles, polyfunctional monomers, and various unsaturated acids. From the above compounds one or two or more are selected to be used in combination as monomers for copolymerization. The polymer of the latex of the invention preferably contains repeating unit derived from the monomer having a water-solubility of not higher than 0.025% in weight at 25° C. in an amount of 10 to 100% by weight, more preferably 50 to 100% by weight.

To show these monomer compounds further in detail, examples of the acrylate include methyl acrylate, ethyl acrylate, n-propyl acrylate, isopropyl acrylate, n-butyl acrylate, iso-butyl acrylate, sec-butyl acrylate, tert-butyl acrylate, amyl acrylate, 2-bromoethyl acrylate, 4-chlorobutyl acrylate, cyanoethyl acrylate, 2-acetoxyethyl acrylate, dimethylaminoethyl acrylate, methoxybenzyl acrylate, 2-chlorocyclohexyl acrylate, furfuryl acrylate, tetrahydrofurfuryl acrylate, phenyl acrylate, 2-hydroxyethyl acrylate, 5-hydroxypentyl acrylate, 2,2-dimethyl-3-hydroxypropyl acrylate, 2-methoxyethyl acrylate, 3-methoxybutyl acrylate, 2-ethoxyethyl acrylate, 2-iso-propoxy acrylate, 2-butoxyethyl acrylate, 2-(2-methoxyethoxy)ethyl acrytate, 2-(2-butoxyethoxy) ethyl acrylate, ω-methoxypolyethylene-glycol acrylate (addition molar number n=9), 1-bromo-2-methoxyethyl acrylate and 1,1-dichloro-2-ethoxyethyl acrylate.

Examples of the methacrylate include methyl methacrylate, ethyl methacrylate, n-propyl methacrylate, isopropyl methacrylate, amyl methacrylate, chlorobenzyl methacrylate, sulfopropyl methacrylate, N-ethyl-N-phenylaminoethyl methacrylate, 2-(3-phenylpropyloxy)ethyl methacrylate, dimethylaminophenoxyethyl methacrylate, furfuryl methacrylate, tetrahydrofurfuryl methacrylate, phenyl methacrylate, cresyl methacrylate, 2-hydroxyethyl methacrylate, 4-hydroxybutyl methacrylate, triethylene-glycol monomethacrylate, dipropyleneglycol monomethacrylate, 2-methoxyethyl methacrylate, 3-methoxybutyl methacrylate, 2-acetoxyethyl methacrylate, 2-acetoacetoxyethyl methacrylate, 2-ethoxyethyl methacrylate, 2-isopropoxyethyl methacrylate, 2-butoxyethyl methacrylate, 2-(2-methoxyethoxy)ethyl methacrylate, 2-(2-ethoxyethoxy)ethyl methacrylate, 2-(2-butoxyethoxy)ethyl methacrylate, ω-methoxypolyethylene-glycol methacrylate (addition molar number n=6), allyl methacrylate and dimethylaminoethylmethyl methacrylate chloride.

Examples of the vinyl ester include vinyl acetate, vinyl propionate, vinyl butyrate, vinyl isobutyrate, vinyl caproate, vinyl chloroacetate, vinylmethoxy acetate, vinylphenyl acetate, vinyl benzoate and vinyl salicylate.

Examples of the olefin include dicyclopentadiene, ethylene, propylene, 1-butene, 1-pentene, vinyl chloride, vinylidene chloride, isoprene, chloroprene, butadiene and 2,3-dimethylbutadiene.

Examples of the styrene include styrene, methy styrene, ethy styrene, chloromethy styrene, methoxystyrene, acetoxystyrene, chlorostyrene, bromostyrene, trifluorostyrene and vinylmethyl benzoate.

Examples of the crotonic acid ester include butyl crotonate.

Examples of the iraconic acid diester include dimethyl itaconate, diethyl itaconate and dibutyl itaconate. Examples of the maleic acid diester include diethyl maleate, dimethyl maleate and dibutyl maleate. Examples of the fumaric acid diester include diethyl fumarate, dimethyl fumarate and dibutyl fumarate. Examples of the acrylamide include acrylamide, methylacrylamide, ethylacrylamide, propylacrylamide, butylacrylamide, tertbutylacrylamide, cyclohexylacrylamide, benzylacrylamide, hydroxymethylacrylamide, methoxyethylacrylamide, dimethylaminoethylacrylamide, phenylacrylamide, dimethylacrylamide, diethylacrylamide, β-cyanoethylacrylamide and N-(2-acetacetoxyethyl)acrylamide.

Examples of the methacrylamide include methacrylamide, methylmethacrylamide, ethylmethacrylamide, propylmethacrylamide, butylmethacrylamide, tert-butylmethacrylamide, cyclohexylmethacrylamide, benzylmethacrylamide, hydroxymethylmethacrylamide, methoxyethylmethacrylamide, dimethylaminoethylmethacrylamide, phenylmethacrylamide, dimethylmethacrylamide, diethylmethacrylamide, β-cyanoethylmethacrylamide and N-(2-acetacetoxyethyl)methacrylamide.

Examples of the allyl compound include allyl acetate, allyl caproate, allyl laurate and allyl benzoate.

Examples of the vinyl ether include methylvinyl ether, butylvinyl ether, hexylvinyl ether, methoxyethylvinyl ether and dimethylaminoethylvinyl ether.

Examples of the vinyl ketone include methylvinyl ketone, phenylvinyl ketone and methoxyethylvinyl ketone.

Examples of the vinyl-heterocyclic compound include vinylpyridine, N-vinyl-imidazole, N-vinyl-oxazolidone, N-vinyl-triazole, N-vinyl-pyrrolidone.

Examples of the glycidyl ester include glycidyl acrylate and glycidyl methacrylate.

Examples of the unsaturated nitrile include acrylonitrile and methacrylonitrile. Those of the polyfunctional monomer include divinylbenzene, methylenebisacrylamide and ethyleneglycol dimethacrylate.

Further, acrylic acid, methacrylic acid, iraconic acid, maleic acid; monoalkyl itaconates such as monomethyl itaconate, monoethyl itaconate and monobutyl itaconate; monoalkyl maleares such as monomethyl maleate, monoethyl maleate and monobutyl maleate; citraconic acid, styrenesulfonic acid, vinylbenzylsulfonic acid, vinylsulfonic acid; acryloyloxyalkylsulonic acids such as acryloyloxyethylsulfonic acid and acryloyloxypropylsulfonic acid; methacryloyloxyalkylsulfonic acids such as methacryloyloxydimethylsulfonic acid, methacryloyloxyethylsulfonic acid and methacryloyloxypropylsulfonic acid; acrylamidoalkylsulfonic acids such as 2-acrylamido-2-methylethanesulfonic acid, 2-acrylamido-2-methylpropanesulfonic acid and 2-acrylamido-2-acid; methacrylamidoalkylsulfonic acids such as 2-methacrylamido-2-methylethanesulfonic acid, 2-methacrylamido-2-methylpropanesulfonic acid and 2-methacrylamido-2-methylbutanesulfonic acid; acryloyloxyalkyl phosphates such as acryloyloxyethyl phosphate and 3-acryloyloxypropyl-2-phosphate; methacryloyloxyalkyl phosphates such as methacrytoyloxyethyl phosphate and 3-methaeryloyloxypropyl-2-phosphatei and naphthyl 3-allyloxy-2-hydroxypropanesulfonate having two hydrophilic groups. These acids may be used in the form of salts of alkali metals such as Na, K or of ammonium ions. As still further monomer compounds there may be used those crosslinking monomers as described in U.S. Pat. Nos. 3,459,790, 3,438,708, 3,554,987, 4,215,195 and 4,247,673, and JP O. P. I. No. 205735/1982. Examples of the crosslinking monomer include N-(2-acetacetoxyethyl)acrylamide and N-(2-(2-acetacetoxyethoxy)ethyl)acrylamide.

The suitably usable among the above monomers compounds are acrylic acid esters, methacrylic acid esters, vinyl esters, styrenes and olefins.

Surfactants usable in the invention may be any of anionic surfactants, nonionic surfactants, cationic surfactants and amphoteric surfactants, and are preferably anionic and/or nonionic surfactants. As the anionic surfactants and/or nonionic surfactants, various compounds known to those skilled in the art may be used, but particularly, anionic surfactants are preferred.

The water-soluble high molecular material used at the time of polymerization of polymer latex of the invention includes synthetic water-soluble polymer materials and natural water-soluble polymer materials; either may be suitably used in the invention. Of these the synthetic and natural water-soluble polymer materials include ones having a nonionic group, ones having an anionic group, ones having a cationic group, ones having both nonionic and anionic groups, ones having both nonionic and cationic groups, and ones having both anionic and cationic groups in their respective molecular structures. The nonionic group includes an ether group, an alkylene-oxide group, a hydroxy group, an amido group and an amino group. The anionic group includes a carboxyl group and its salts, a phospho group and its salts, a sulfo group and its salts. The cationic group includes a quaternary ammonium salt group and a tertiary amino group. Among these synthetic and natural high molecular material, those having an anionic group or having both of an anionic group and a nonionic group are preferable.

In the invention, the water-soluble polymer is one having a solubility of preferably not less than 0.05 g, and more preferably not less than 0.1 g in 100 g of water at 20° C. The water-soluble polymer used in the invention accounts for preferably not less than 5% and not more than 30% by weight, and more preferably not less than 1% and not more than 15% by weight of the latex polymer.

Examples of the natural water-soluble polymer includes those described in detail in the Collection of Technological Data for Water-Soluble Polymer Water-Dispersed Resins (Keiei-Kaihatsu Center), and preferably lignin, starch, pullulan, cellulose, dextran, dextrin, glycogen, alginic acid, gelatin, collagen, guar gum, gum arabic, laminarin, lichenin, nigellone and their derivatives. As derivatives of these natural water-soluble polymers there may be preferably used those sulfonated, carboxylated, phosphated, sulfoalkylenated, carboxyalkylenated, alkyl-phosphated and salts thereof, and more preferably glucose, gelatin, dextran, cellulose and their derivatives.

The polymer latex used in the invention can be produced easily by any one of various methods, such as by redispersing a polymer that has been obtained in the emulsion polymerization, solution polymerization or block polymerization process.

The glass transition point Tg of the polymer to form the polymer latex used in the invention is preferably not more than 60° C., and more preferably not more than 40° C.

A Tg value calculated according to the above formula has a precision of ±5° C.

Synthetic methods of the polymer latex used in the invention are described in detail in U.S. Pat. Nos. 2,852,386, 2,853,457, 3,411,911, 3,411,912 and 4,197,127, Belgian Patent Nos. 688,882, 691,360 and 712,823, JP E. P. No. 5331/1970, JP O. P. I. Nos. 18540/1985, 130217/1976, 137831/1983 and 50240/1980.

The polymer latex of the invention has an average particle size of preferably 0.5 to 300 nm, and more preferably 30 to 250 nm.

Measurement of the particle size of the polymer latex of the invention may be made according to the electron-microscopic photography method, soap titration method, light-scattering method or centrifugal sedimentation method described in the 'Polymer Latex Chemistry' (Kobunshi-Kanko Kai, 1973), but of them the light-scattering method is suitably used. As a measuring instrument for the light-scattering method, a DLS700, manufactured by Ohtsuka Denshi Co. was used in the invention.

The whole molecular weight of the polymer latex used in the invention, although not restricted, is preferably from 1,000 to 1,000,000, and more preferably 2,000 to 500,000.

The polymer latex of the invention may, either as it is or in the state of being dispersed in water, be incorporated into photographic component layers. As for the latex polymer content of the layer, it is preferably added in an amount of 5 to 70% by weight of the total weight of the binder contained in the whole the photographic component layer. The polymer latex further may be added to any photographic component layer provided on the side on which the latex containing lay is coated, regardless of whether it is light-sensitive or non-light-sensitive other than the layer positioned at farthest position from the support.

The polymer latex of the invention includes also functional polymers such as polymer couplers or polymer UV absorbing agents which are added in the form of latexes.

Examples of the polymer latex according to the invention are listed below, wherein each suffixed number represents the content percentage of each monomer unit.

| | | Surfactant |
|---|---|---|
| Lx-1 | $\leftarrow CH_2-CH\rightarrow_{100}$ (0.010)<br>$COOCH_2CHC_4H_9$<br>$C_2H_5$ | Sf-1 |
| Lx-2 | $\leftarrow CH_2-CH\rightarrow_{100}$ (0.010)<br>$COOCH_2CHC_4H_9$<br>$C_2H_5$ | P-3 |
| Lx-3 | $\leftarrow CH_2-CH\rightarrow_{100}$ (0.004)<br>$COOC_9H_{19}$(iso) | P-2 |
| Lx-4 | $\leftarrow CH_2-CH\rightarrow_{100}$ (0.010)<br>$COOCH$, $CH_2-CH_2$, $CH_3$, $CH_2-CH_2$ | P-1 |
| Lx-6 | $\leftarrow CH_2-CH\rightarrow_{55}$ (0.004)<br>$COOC_9H_9$(iso)<br>$\leftarrow CH_2-CH\rightarrow_{45}$ (0.030) | Sf-2 |
| Lx-7 | $CH_3$<br>$\leftarrow CH_2-C\rightarrow_{100}$ (0.003)<br>$COOCH_2CHC_4H_9$<br>$C_2H_5$ | Dextransulfate |
| Lx-8 | $CH_3$<br>$\leftarrow CH_2-C\rightarrow_{100}$ (0.003)<br>$COOCH_2CHC_4H_9$<br>$C_2H_5$ | P-4 |
| Lx-10 | $CH_3$<br>$\leftarrow CH_2-C\rightarrow_{30}$ (0.003)<br>$COOC_9H_9$(iso)<br>$\leftarrow CH_2-CH\rightarrow_{70}$ (0.010)<br>$COOCH$, $CH_2-CH_2$, $CH_2$, $CH_2-CH_2$ | Sf-2 |
| Lx-11 | $CH_3$<br>$\leftarrow CH_2-C\rightarrow_{100}$ (0.003)<br>$COOC_9H_{19}$(n) | Sf-1 |

-continued

| | | Surfactant |
|---|---|---|
| Lx-12 | $\text{-}(CH_2\text{-}CH)_{50}\text{-}$ ($COOC_8H_{17}(n)$) (0.010) $\text{-}(CH_2\text{-}C(CH_3))_{50}\text{-}$ ($COOCH_3$) (1.72) | Sf-3 |
| Lx-13 | $\text{-}(CH_2\text{-}CH)_{50}\text{-}$ ($COOC_8H_{17}(n)$) (0.010) $\text{-}(CH_2\text{-}C(CH_3))_{40}\text{-}$ ($COOCH_3$) (1.720) $\text{-}(CH_2\text{-}C(CH_3))_{10}\text{-}$ ($COOCH_2CH\text{-}CH_2$, O) (2.500) | Sf-4 |
| Lx-14 | $\text{-}(CH_2\text{-}CH)_{50}\text{-}$ ($COOC_8H_{17}$) (0.010) $\text{-}(CH_2\text{-}CH)_{50}\text{-}$ (benzene) (0.030) | Sf-3 |
| Lx-15 | $\text{-}(CH_2\text{-}CH)_{40}\text{-}$ ($COOC_8H_{17}$) (0.010) $\text{-}(CH_2\text{-}CH)_{50}\text{-}$ ($COOCH$, $CH_2\text{-}CH_2$, $CH_2$, $CH_2\text{-}CH_2$) (0.010) $\text{-}(CH_2\text{-}C(CH_3))_{10}\text{-}$ ($COOCH_2CH\text{-}CH_2$, O) (2.50) | P-2 |
| Lx-19 | $\text{-}(CH_2\text{-}CH)_{20}\text{-}$ ($COOC_9H_{19}(iso)$) (0.004) $\text{-}(CH_2\text{-}CH)_{50}\text{-}$ ($COOCH$, $CH_2\text{-}CH_2$, $CH_2$, $CH_2\text{-}CH_2$) (0.010) $\text{-}(CH_2\text{-}C(CH_3))_{30}\text{-}$ ($COOCH$, $CH_2\text{-}CH_2$, $CH_3$, $CH_2\text{-}CH_2$) (0.004) | P-2<br>Sf-3 |
| Lx-20 | $\text{-}(CH_2\text{-}CH)_{20}\text{-}$ ($COOC_9H_{19}(iso)$) (0.004) $\text{-}(CH_2\text{-}CH)_{50}\text{-}$ ($COOCH$, $CH_2\text{-}CH_2$, $CH_2$, $CH_2\text{-}CH_2$) (0.010) $\text{-}(CH_2\text{-}C(CH_3))_{30}\text{-}$ ($COOCH$, $CH_2\text{-}CH_2$, $CH_3$, $CH_2\text{-}CH_2$) (0.004) $\text{-}(CH_2\text{-}C(CH_3))_{30}\text{-}$ ($COOCH_2CH\text{-}CH_2$, O) (2.50) | P-2<br>Sf-3 |

-continued

| | | | | Surfactant |
|---|---|---|---|---|
| Lx-21 | $\text{-}(CH_2\text{-}CH)_{50}\text{-}$ $COOCH_2CHC_4H_9$ $C_2H_5$ (0.01) | $\text{-}(CH_2\text{-}C)_{40}\text{-}$ $COOCH$ $CH_2\text{-}CH_2$ $CH_2$ $CH_2\text{-}CH_2$ (0.003) | $CH_3$ $\text{-}(CH_2\text{-}C)_{10}\text{-}$ $COOCH$ $CH_2\text{-}CH_2$ $CH_2$ $CH_2\text{-}CH_2$ (0.004) | Sf-3 |

Sf-1

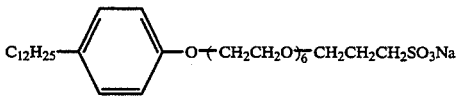

Sf-2

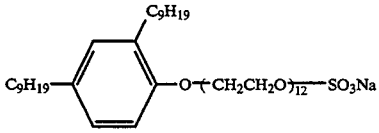

Sf-3

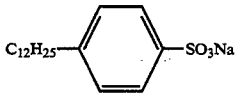

Sf-4 $C_{12}H_{25}OSO_3Na$

P1

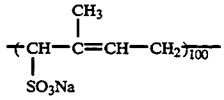

Mw = 5000

P2

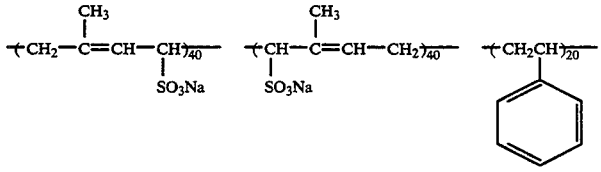

Mw = 40000

P3

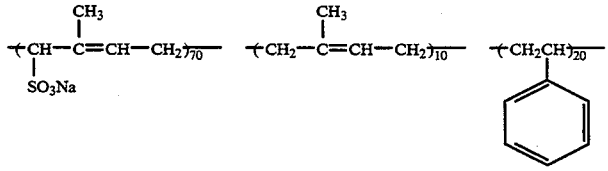

Mw = 40000

P4

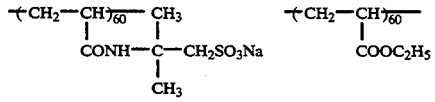

150,000

As the binder of the silver halide emulsion layer gelatin and gelatin derivatives are advantageously usable.

As the gelatin, in addition to lime-treated gelatin there may be used those acid-treated gelatin products as described in Bull, Soc, Sci, Phot, Japan No.16, p.30 (1966), and also hydrolyzed products or oxygen-decomposed products of gelatin. As the gelatin derivative there may be used those obtained by the reaction of gelatin with various compounds such as acid halides, acid unhydrides, isocyanates, bromoacetates, alkanesultones, vinylsulfonamides, maleimide compounds or polyalkylene-oxide or epoxy compounds; particular examples of which are described in U.S. Pat. Nos. i,614,928, 3,132,945, 3,186,846 and 3,321,553; British Patent Nos. 861,414, 1,033,189 and 1,005,784; and JP E.P. No. 26845/1967.

EXAMPLES

The invention will be explained in detail in the followings with examples.

EXAMPLE 1

Preparation of Seed Emulsion 1

While maintaining a temperature of 60° C., a pAg of 8 and a pH of 2.0, monodisperse cubic grains of silver iodobromide having an average grain size of 0.3 μm and a silver iodide content of 2 mol % were prepared by the double-jet method. While maintaining a temperature of 60° C., a pAg of 8 and a pH of 2.0, monodisperse cubic grains of silver iodobromide having an average grain size of 0.3 μm and a silver iodide content of 2 mol % were prepared by the double-jet method.

The resulting reaction mixture was desalinized at 40° C., using an aqueous solution of Demol-N (produced by Kao Atlas) and an aqueous solution of magnesium sulfate, after which it was re-dispersed in an aqueous gelatin solution, to yield a seed emulsion.

Growing the Seed Emulsion 1

The seed grains of the above seed emulsion were grown as follows:

The seed emulsion was dispersed in a gelatin solution kept at 40° C. and the pH of the solution was controlled to 9.7 with ammonia water and acetic acid. An aqueous solution of ammoniacal silver nitrate and an aqueous solution of potassium bromide and potassium iodide were then added to the dispersion by the double jet method, while maintaining a pAg of 7.3 and a pH of 9.7, to form a layer of silver iodobromide containing 35 mol % silver iodide on the seed grain. Next, another aqueous solution of ammoniacal silver nitrate and an aqueous solution of potassium bromide were added by the double jet method. Until 95% of the desired grain size was reached, the pAg was kept at 9.0, the pH being varied continuously over the range from 9.0 to 8.0. The pAg of the dispersion was then changed to 11.0, and while keeping the pH at 8.0, grains were grown until the desired grain size was obtained. Subsequently, acetic acid was added to obtain a pH of 6.0. Then anhydride of 5,5'-dichloro-9-ethyl-3,3'-di-(3-sulfopropyl)-oxacarbocyanine sodium salt (sensitizing dye GD-1) at 400 mg per mol of silver halide was added to the emulsion. The emulsion was desalted using an aqueous solution of Demol-N and an aqueous solution of magnesium sulfate, the flocculate was redispersed by the addition of a gelatin solution.

Monodisperse silver iodobromide emulsions A, B and comprising tetradecahedral grains with round apexes having an average silver iodide content of 2.0 mol %, were thus prepared, which had average grain sizes of 0.40 μm, 0.65 μm and 1.00 μm and variation coefficients (δ/r) of 0.17, 0.16 and 0.16, respectively.

Preparation of Seed Emulsion 2

An aqueous solution of silver nitrate and an aqueous solution containing equimolar potassium bromide and hydrogen peroxide-treated gelatin were added to an aqueous solution of 0.05N potassium bromide containing hydrogen peroxide-treated gelatin at 40° C. with vigorous stirring by double-jet method. The temperature of the reacting liquid was lowered after 1.5 minutes of the start of the addition by 25° C. spending 30 minutes. Then 28% ammonia water was added in an amount of 80 ml per mol of silver nitrate to the liquid and the liquid was stirred for 5 minutes.

The pH of the liquid was adjusted to 6.0 with acetic acid and was desalted using an aqueous solution of Demol-N and an aqueous solution of magnesium sulfate. The flocculate was redispersed by addition of gelatin solution.

Thus obtained seed emulsion comprises spherical grins having an average grain size of 0.23 μm and a variation coefficient of 0.28.

Growing the Seed Emulsion 2

The seed grains of the above seed emulsion were grown as follows:

An aqueous solution of potassium bromide and potassium iodide and an aqueous solution of silver nitrate were added by double-jet method with vigorously stirring to an aqueous solution containing ossein gelatin and disodium propyloxy-polyethyleneoxy-disuccinate maintaining at 75° C. The values of pH and pAg of the mixture was maintained at 5.8 and 9.0, respectively, in the course of the addition. After completion of the addition, the pH of the mixture was adjusted to 6.0 and 400 mg/mol Ag of sensitizing dye GD-1 was added.

Then the emulsion is desalted using Demol N, product of Kao-Atlas Co., and redispersed with an aqueous gelatin solution. Tabular grain silver iodobromide emulsions D-1, D-2, D-3 and D-4 were prepared which have a silver iodide content of 1.5 mol %, a circle equivalent diameter of 0.96 μm, and a variation coefficient of 0.25, and an aspect ratio of 2.0, 3.5, 5.0 and 8.0, respectively.

Synthesis Example 1: Synthese of Lx-1

Three hundred and fifty milliliters of water were put in a 1,000 ml four-neck flask equipped with a stirrer, a thermometer, a dropping funnel, a nitrogen conduction pipe and a flux condenser with its inside being deoxidized by conducting nitrogen gas thereinto, and was heated until the inside temperature reached 80° C., and to this were added 4.5 g of a dispersing agent Sf-1, 0.45 g of ammonium persulfate as a polymerization initiator, and then added dropwise 90 g of ethylhexyl acrylate for about an hour through the dropping funnel. After completion of the dropwise addition, the reaction was still continued over a period of 5 hours, and then the unreacted monomer moiety was removed by steam distillation. After ward, the product was cooled and then its pH was adjusted to 6 with ammonia water, whereby a polymer latex having an average particle size of 150 nm was obtained.

Synthesis Example 2: Synthesis of Lx-2

Three hundred and fifty milliliters of water were put in a 1,000 ml four-neck flask equipped with a stirrer, a thermometer, a dropping funnel, a nitrogen conduction tube and a flux condenser with its inside being deoxidized by conducting nitrogen gas thereinto and was heated until the inside temperature reached 80° C., and to this were added 4.5 g of a dispersing agent P-3, 0.45 g of ammonium persulfate as a polymerization initiator, and then dropwise added 90 g of ethylhexyl acrylate for about an hour through the dropping funnel. After completion of the dropwise addition, the reaction was still continued over a period of 4 hours, the unreacted monomer moiety was removed by steam distillation, afterward, the product was cooled and its pH was adjusted to 6 with ammonia water, whereby an objective polymer latex having an average particle size of 200 nm was obtained.

Synthesis Example 3: Synthesis of Lx-10

Two hundred milliliters of dioxane were put in a 500 ml three-neck flask with its inside being deoxidized by conducting nitrogen gas thereinto, and later to this were added 15 g of isononyl acrylate, 35 g of cyclohexyl acrylate and then 1.2 g of dimethyl azobisisobutyrate as a polymerization initiator to have their reaction continue for 6 hours at 60° C. After completion of the reaction, the reaction liquid was poured in 3 liters of distilled water with vigorously stirring, whereby white crystals were obtained.

The white crystals were filtered, dried, and then dissolved in 100 ml of ethyl acetate. This solution was added with vigorously stirring to 500 ml of distilled water containing 2 g of Sf-2, and then the ethyl acetate was removed, whereby an objective polymer latex having an average particle size of 180 nm was obtained.

Synthesis Example 4: Synthesis of Comparative Latex L

To a solution of 0.05 kg of KMDS (sodium dextran sulfate, produced by Meito Ind. Co.) and 0.05 kg of ammonium persulfate dissolved in 40 liters of water, with stirring at 81° C. under a nitrogen atmospheric condition, was added spending an hour a mixture of 4.51 kg of n-butyl acrylate, 5.49 kg of styrene and 0.1 kg of acrylic acid, and after that 0.005 kg of ammonium persulfate was added, and further after 1.5-hour stirring, the latex product was cooled and its pH was adjusted to 6 with ammonia water.

The obtained latex was filtered by using a GF/D filter, manufactured by Whotman Co., and water was added to make the whole liquid 50.5 kg, whereby a monodisperse Latex (L) having an average particle size of 250 nm was obtained.

To thus obtained emulsions A, B, C, D and D-1 through D-4, GD-1 and sodium salt of 5,5'-di-(butoxycarbonyl)-1,1'-diethyl-(4-sulfobutyl)benzoimidazolocarbocyanine anhydride was added in an amount of 975 mg for A, 600 mg for B, 390 mg for C and 500 mg for D-1 through D-4 per mol of silver halide.

Ten minutes later, appropriate amounts of chloroauric acid, sodium thiosulfate and ammonium thiocyanate were added for chemical sensitization. Fifteen minutes before completion of ripening, potassium iodide was added at 200 mg per mol of silver halide. Subsequently, 4-hydroxy-6-methyl-1,3,3*a*,7-tetrazaindene was added at $3\times10^{-2}$ mol per mol of silver halide, and this mixture was dispersed in an aqueous solution of 70 g of gelatin.

Emulsions A, B and C were mixed in a ratio of 15:65:20 to yield emulsion R-1, and emulsions D-1 through D-4 were respectively used without mixing.

Additives described on page 95, line 16, to page 96, line 20, of JP O. P. I. Publication 301744/1990 were added to each of the emulsions.

Further, 1.2 g of the following dispersion of dye was added to each of the emulsion to prepare a coating solution.

Preparation of Dye Dispersion

In a solvent composed of 28 liter of tricresyl phosphate and 85 liter of ethyl acetate, 10 Kg of the following dye was dissolved at 55° C., which was referred as oil-medium. On the other hand, a 9.3% gelatin solution containing 1.35 Kg of anionic surfactant AS was prepared, which was referred as aqueous-medium.

The oil-medium and the aqueous-medium were put into a vessel and were dispersed at 40° C.

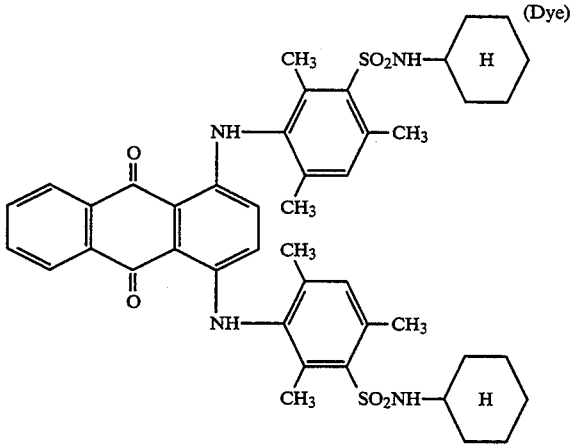

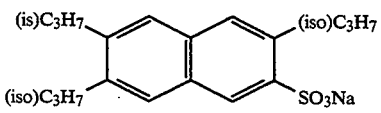

Additives used in the protective layer were as follows. The amounts of the additives were those per liter of the coating solution.

| Coating solution of protective layer | |
|---|---|
| Lime-processed inert gelatin | 68 g |
| Acid-processed gelatin | 2 g |
| Sodium isoamyl-n-decylsulfosuccinate | 0.3 g |
| Polymethyl methacrylate (matting agent of area-average grain size of 5.0 μm) | 1.1 g |
| Silicon dioxide particles (matting agent of area-average grain size of 3.0 μm) | 0.5 g |
| Ludox AM (colloidal silica, produced by Du Pont) | 30 g |
| Glyoxal, 40% solution (Hardener) | 1.5 ml |
| $(CH_2{=}CHSO_2(CH_2)_2O$ (Hardener) | 500 mg |
| 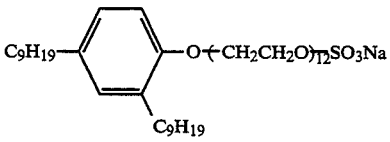 | 1.0 g |
| 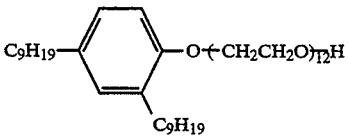 | 0.4 g |
| $NaO_3S{-}CH(CH_2COOCH_2(C_2F_4)_3H)COOCH_2(C_2F_4)_3H$ | 0.5 g |

Each of the emulsions and the protective layer were simulataneously coated on both side of a polyethylene telephthalate support having a thickness of 175 μm by two slide hopper coaters with a coating speed of 90 m per minute so that the coating amount of the emulsion to be 2.0 g/m$^2$ in terms of silver and 2.5 g/m$^2$ in terms of gelatin and the coating of the protective layer to be 0.99 g/m$^2$ in terms of gelatin per one side of the support. The polyethylene telephthalate support was previously subbed with a 10% aqueous dispersion of glysisylmethacrylate-methyl methacrylate-butyl methacrylate, 50:10:40 wt %, copolymer. The coated film was dried spending 2 minutes and 15 seconds. Thus Samples 1 to 15 were prepared. The content of the samples were given in the following Table 1.

TABLE 1

| Sample No. | Emulsion No. | Aspect ratio | Latex No. | Latex Amount added ($g/m^2$) |
|---|---|---|---|---|
| 1 | R-1 | — | L | 1.0 |
| 2 | R-1 | — | Lx-1 | 1.0 |
| 3 | D-1 | 2.0 | L | 1.0 |
| 4 | D-1 | 2.0 | Lx-1 | 1.0 |
| 5 | D-2 | 3.5 | — | — |
| 6 | D-2 | 3.5 | Lx-1 | 0.5 |
| 7 | D-2 | 3.5 | Lx-1 | 1.0 |
| 8 | D-2 | 3.5 | Lx-1 | 1.5 |
| 9 | D-2 | 3.5 | Lx-2 | 0.02 |
| 10 | D-2 | 3.5 | Lx-2 | 0.5 |
| 11 | D-2 | 3.5 | Lx-2 | 2.5 |
| 12 | D-2 | 3.5 | Lx-2 | 1.0 |
| 13 | D-2 | 3.5 | Lx-10 | 1.0 |
| 14 | D-3 | 5.0 | Lx-10 | 1.0 |
| 15 | D-4 | 8.5 | Lx-10 | 1.0 |

These samples were evaluated as follows:

Sensitometry

The sample was placed between two sheets of fluorescent intensifying paper KO-250, product of Konica Corp., and exposed to X-ray of a bulb potential of 90 KVP for 0.05 seconds with the distance method to draw a photographic characteristic curve. The sensitivity and gamma value of the sample was determined from the characteristic curve. The sensitivity was determined as the reciprocal of the X-ray amount necessary to form a density of fog +0.1. The test results were expressed by relative values to that of sample 1 which was set as 100.

The gamma value ($\gamma$) was defined as tan $\theta$ in which $\theta$ is the gradient of a straight line connecting the point of density of 1.0 and the point of density of 2.0 of the characteristic curve.

The processing was carried out by Auto Processor SRX-501, produced by Konica Corp., with a development temperature of 35° C. and a fixing temperature of 33° C. Washing was performed with washing water of 18° C., supplying amount of it was 3.5 1 per minute. Drying temperature was 45° C. and the all processing was carried out in the following 45 seconds mode.

| Processing | Temperature (°C.) | Time (Sec.) | Replenishing amount |
|---|---|---|---|
| Insert | — | 1.2 | |
| Development and carry over | 35 | 14.6 | 33 ml/sheet (251 mm × 302 mm) |
| Fixing and carry over | 33 | 8.2 | 63 ml/sheet (251 mm × 302 mm) |
| Washing and carry over | 18 | 7.2 | 3.5 l/min. |
| Squeezing | 40 | 5.7 | |
| Drying | 45 | 8.1 | |
| Total | | 45.0 | |

Developer

| | |
|---|---|
| Potassium sulfite | 70 g |
| Trisodium hydroxyethylenediaminetriacetate | 8 g |
| 1,4-dihydroxy benzene | 28 g |
| Boric acid | 10 g |
| 5-methylbenzotriazole | 0.04 g |
| 1-phenyl-5-mercaptotetrazole | 0.01 g |
| Sodium metabisulfite | 5 g |
| Acetic acid (90%) | 13 g |
| Triethylene glycol | 15 g |
| 1-phenyl-3-pyrazolidone | 1.2 g |
| 5-nitroindazole | 0.2 g |

-continued

| | |
|---|---|
| Glutalaldehyde | 4 g |
| Dissolve in 1 liter of water and adjust pH to 10.4 with sodium hydroxide. | |
| Starter solution | |
| Potassium bromide | 300 g |
| Glacial acetic acid | 144 g |
| Water to make | 1 l |
| Fixing solution | |
| Sodium thiosulfate pentahydrate | 4.5 g |
| Disodium ethylenediaminetetraacetate | 0.5 g |
| Ammonium thiosulfate | 150 g |
| Sodium sulfite anhydrite | 8 g |
| potassium acetate | 16 g |
| Aluminum sulfate 10-18 hydrate | 10 g |
| Sulfuric acid (50 wt %) | 5 g |
| Citric acid | 1 g |
| Boric acid | 7 g |
| Glacial acetic acid | 5 g |
| Water to make | 1 l |
| Adjust pH to 4.2 with glacial acetic acid. | |

The following dryness property, scratch resistance and specific surface resistance were evaluated as the tests for the processability. The results thereof will be shown in Table 2.

Evaluation of Dryness Property

A sample was cut into 35.6 cm×35.6 cm size. It was exposed to light so that an after-developed density can be 1.0 and was then subjected to a super-rapid process under the afore-mentioned conditions. Immediately after the test film was passed through the dried portions, the film was touched with hand so that the degrees of the dryness of the film was evaluated overall. The results of the evaluation were shown by five grades from grade 5 (to be excellent) to grade 1 (to be poor).

Criteria of the Evaluation

Grade 1: Wet on the whole surface.

Grade 2: Wet on a surface a half or more. The subject film was readily sticky and scratchy when it was scratched.

Grade 3: Partly wet, but not sticky.

Grade 4: Felt wet a few and cold on the surface.

Grade 5: Felt smooth and warm to the touch.

There was no problem from grade 3 to grade 5, but not applicable to any practical use.

Scratch Resistance Test

In a darkroom, a sample was scratched by applying a load of 100 $g/cm^2$ with a Nylon-made brush available on the market and was then developed through the foregoing automatic processor. The developed sample was evaluated by the following four grades, A through D.

Evaluation Criteria

A: Almost no scratch found.

B: Leveled to be no problem practically, but some scratches were found.

C: Practically problematic, because scratches produced almost apparently.

D: Many scratches found so serious that the scratches were wide and the densities thereof were also high.

Specific Surface Resistance Test

A subject sample was rehumidified for one hour under the conditions of 20% RH and was then sandwiched between a pair of 100 mm-length brass-made electrodes having a gap of 14 mm therebetween, so that the specific surface resistance of the sample was measured for one minute under the conditions of 23° C. and 20% RH by making use of an insulation tester Model TR-8651 manufactured by Takeda Rika Co.

Stickiness Test

A subject sample was cut into a size of 7 cm × 13.5 cm and rehumidified for one hour under the conditions of 80% RH. Thereafter, two sheets of film were put one upon another and were then allowed to stand by applying a load of 1 kg for three days. When peeling them apart after 3 days, the feeling of the peeling them was regarded as the stickiness level. The criteria for the evaluation were given below.

Evaluation Criteria

Grade 5: Felt to be smooth.

Grade 4: Felt sticky a little.

Grade 3: Firmly stuck and a peeling noise was apparently produced.

Grade 2: Stuck and the emulsion was peeled off.

Grade 1: Stuck a half or more so as hardly to be peeled off.

The results of the above-mentioned evaluation will be shown in Table 2.

TABLE 2

| | Photographic characteristics | | | Processing characteristics | | | | |
|---|---|---|---|---|---|---|---|---|
| Sample No. | Sensitivity | Gamma | Fog | Dryness | Scratch | Specific surface resistance ($\mu\Omega$) | Stickiness | Remarks |
| 1 | 100 | 1.9 | 0.04 | 2 | C | $2.0 \times 10^{13}$ | 2 | Comp. |
| 2 | 100 | 2.0 | 0.04 | 4 | B | $2.7 \times 10^{11}$ | 4 | Comp. |
| 3 | 115 | 2.1 | 0.04 | 1 | D | $7.2 \times 10^{13}$ | 1 | Comp. |
| 4 | 115 | 2.1 | 0.02 | 4 | B | $2.7 \times 10^{11}$ | 4 | Comp. |
| 5 | 143 | 2.7 | 0.07 | 2 | D | $3.2 \times 10^{11}$ | 4 | Comp. |
| 6 | 126 | 2.7 | 0.01 | 4 | A | $2.0 \times 10^{11}$ | 4 | Inv. |
| 7 | 141 | 2.7 | 0.01 | 5 | A | $2.0 \times 10^{11}$ | 5 | Inv. |
| 8 | 145 | 2.7 | 0.01 | 5 | A | $1.9 \times 10^{11}$ | 5 | Inv. |
| 9 | 140 | 2.7 | 0.01 | 4 | B | $2.0 \times 10^{11}$ | 5 | Inv. |
| 10 | 142 | 2.7 | 0.01 | 5 | A | $1.9 \times 10^{11}$ | 5 | Inv. |
| 11 | 143 | 2.7 | 0.02 | 4 | A | $4.0 \times 10^{11}$ | 4 | Inv. |
| 12 | 143 | 2.7 | 0.01 | 5 | A | $2.0 \times 10^{11}$ | 5 | Inv. |
| 13 | 144 | 2.7 | 0.01 | 5 | A | $2.1 \times 10^{11}$ | 5 | Inv. |
| 14 | 150 | 2.8 | 0.02 | 5 | A | $1.9 \times 10^{11}$ | 5 | Inv. |
| 15 | 156 | 2.9 | 0.02 | 5 | A | $1.7 \times 10^{11}$ | 5 | Inv. |

Comp.: Comparison
Inv.: Invention

As is obvious from the results shown in Table 2, it was proved that a silver halide photographic light-sensitive material of the invention containing the tabular-shaped silver halide grains each having an aspect ratio of not lower than 3 and the hydrophilic colloidal layer positioned farthest from the support contains a polymer latex polymerized of at least one kind of monomers having a water-solubility of not lower than 0.025% by weight at a temperature of 25° C.; such photographic light-sensitive material can display the photographic characteristics excellent in a sensitivity, a dryness property, a scratch resistance, an antistaticity and a stickiness resistance, as well as the excellent processing characteristics.

What is claimed is:

1. A silver halide photographic light-sensitive material comprising a support having thereon a silver halide emulsion layer and a gelatin protective layer provided at the farthest position from the surface of said support, wherein said silver halide emulsion layer contains tabular silver halide grains each having an aspect ratio of not less than 3; and said gelatin protective layer contains 50% to 100% by weight of a polymer latex comprising a polymer which comprises a repeating unit derived from a monomer having a solubility in water of not higher than 0.025 % by weight at 25° C.

2. The light-sensitive material of claim 1, wherein the total projection area of the tabular silver halide grains each having an aspect ratio of not less than 3 accounts for not less than 50 % of the total projection area of the whole silver halide grains contained in said silver halide emulsion layer.

3. The light-sensitive material of claim 1, wherein the average size of said silver halide grains is 0.2 μm to 2.5 μm.

4. The light-sensitive material of claim 3, wherein the average size of said silver halide grains is 0.5 μm to 2.0 μm.

5. The light-sensitive material of claim 1, wherein the average thickness of said tabular silver halide grains is not thicker than 0.4 μm.

6. The light-sensitive material of claim 1, wherein the average thickness of said tabular silver halide grains is not thicker than 0.3 μm.

7. The light-sensitive material of claim 1, wherein said monomer having a solubility in water of not higher than 0.025% in weight at 25° C. is an acrylic acid ester, a methacrylic acid ester, a vinyl ester, a styrene or an olefin.

8. The light-sensitive material of claim 1, wherein said polymer of the latex has a weight average molecular weight of 1,000 to 1,000,000.

9. The light-sensitive material of claim 8, wherein said polymer of the latex has a weight average molecular weight of 2,000 to 500,000.

10. The light-sensitive material of claim 1, wherein said polymer of the latex has a glass transition point of not higher than 60° C.

11. The light-sensitive material of claim 10, wherein said polymer of the latex has a glass transition point of not higher than 40° C.

12. The light-sensitive material of claim 1, wherein the content of the polymer of said latex in said gelatin protective layer is 5% to 70% by weight of the total weight of binder provided on the side of the support on which said silver halide emulsion layer and said gelatin protective layer.

* * * * *